United States Patent [19]

Wilson

[11] Patent Number: 4,786,291

[45] Date of Patent: Nov. 22, 1988

[54] METHOD FOR INCREASING STEAM DECOMPOSITION IN A COAL GASIFICATION PROCESS

[75] Inventor: Marvin W. Wilson, Fairview, W. Va.

[73] Assignee: The United States of America as represented by the Department of Energy, Washington, D.C.

[21] Appl. No.: 28,921

[22] Filed: Mar. 23, 1987

[51] Int. Cl.[4] ..... C10J 3/00

[52] U.S. Cl. ..... 48/202; 48/206; 48/210

[58] Field of Search ..... 48/202, 206, 210, 197 R; 252/373; 423/415 A, 648 R

[56] References Cited

U.S. PATENT DOCUMENTS 4,082,519 4/1978 Steiner ..... 48/202

4,440,733 4/1984 Lawson et al. ..... 423/648 R

OTHER PUBLICATIONS

Petrucci, R. H., General Chemistry Principles and Modern Applications, 1985, pp. 433 and 434.

Sneed et al., General Inorganic Chemistry, 7th Edition, 1942, pp. 512–521.

*Primary Examiner*—David L. Lacey

*Assistant Examiner*—Joye L. Woodard

*Attorney, Agent, or Firm*—Earl L. Larcher; Stephen D. Hamel; Judson R. Hightower

[57] ABSTRACT

The gasification of coal in the presence of steam and oxygen is significantly enhanced by introducing a thermochemical water-splitting agent such as sulfuric acid, into the gasifier for decomposing the steam to provide additional oxygen and hydrogen usable in the gasification process for the combustion of the coal and enrichment of the gaseous gasification products. The addition of the water-splitting agent into the gasifier also allows for the operation of the reactor at a lower temperature.

6 Claims, 1 Drawing Sheet

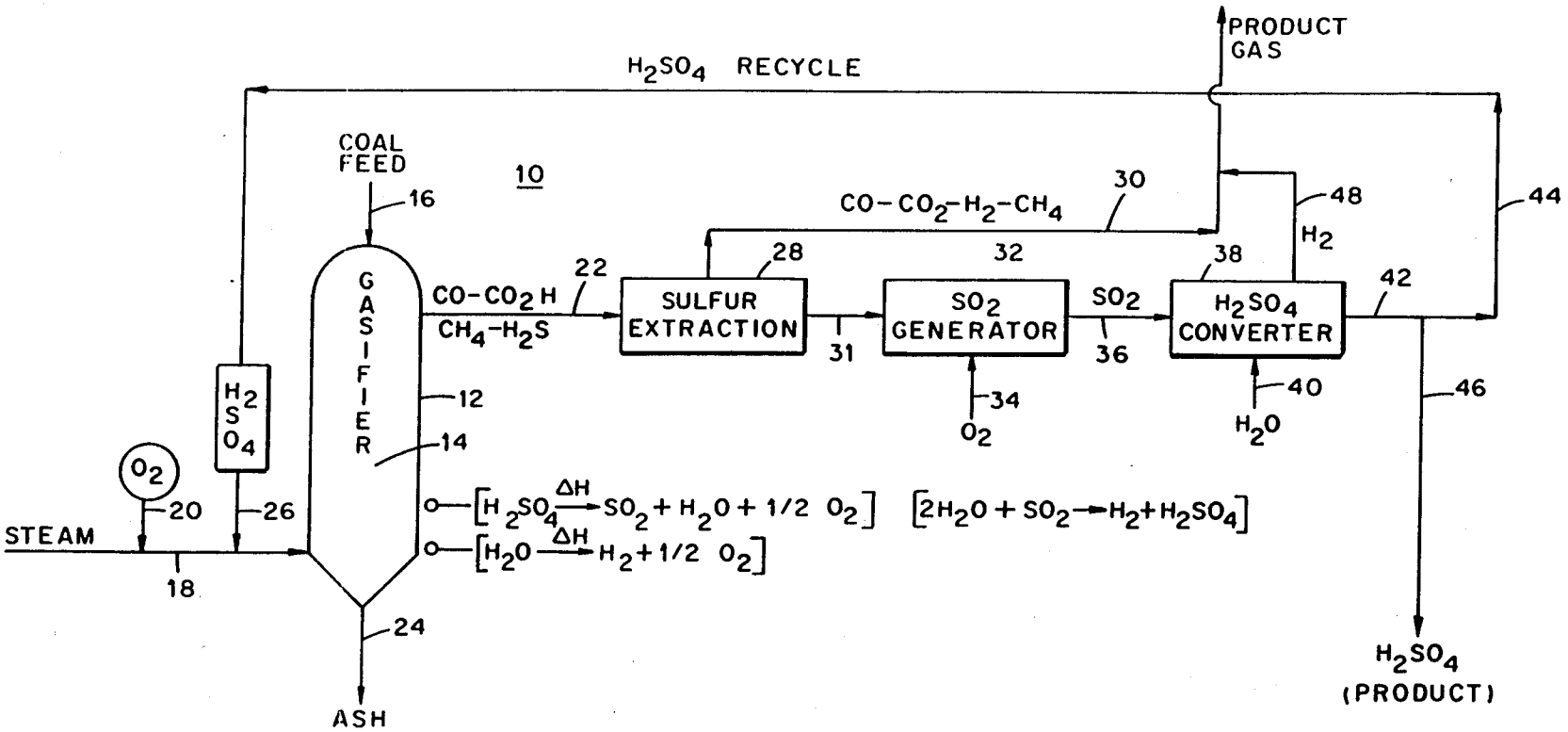
PRODUCT GAS
44
46
$H_2SO_4$ (PRODUCT)
42
48
$H_2$
$H_2SO_4$ CONVERTER
40
$H_2O$
38
30
$SO_2$
36
$CO-CO_2-H_2-CH_4$
32
$SO_2$ GENERATOR
34
$O_2$
$[2H_2O + SO_2 \rightarrow H_2 + H_2SO_4]$
31
28
SULFUR EXTRACTION
$H_2SO_4$ RECYCLE
22
10
$CO-CO_2H$
$CH_4-H_2S$
12
14
$[H_2SO_4 \xrightarrow{\Delta H} SO_2 + H_2O + 1/2\ O_2]$
$[H_2O \xrightarrow{\Delta H} H_2 + 1/2\ O_2]$
COAL FEED
16
GASIFIER
24
ASH
$H_2SO_4$
26
$O_2$
20
18
STEAM

METHOD FOR INCREASING STEAM DECOMPOSITION IN A COAL GASIFICATION PROCESS

BACKGROUND OF THE INVENTION

The present invention relates generally to the gasification of coal in the presence of steam for the production of high quality combustible gases, and more particularly to a method for increasing the decomposition of such steam in the gasifier by adding a water-splitting agent to the gasifier.

The gasification of coal and other carbon-bearing material such a oil shale have been successfully used for the production of fuel or synthesis gas having a sufficient BTU content for use in various industrial applications. The gasification of coal in a typical gasifier is provided by the injection of air, oxygen enriched air, or oxygen, and steam to gasify the coal in the presence of heat for the production of the synthesis gas which is normally formed of carbon monoxide, carbon dioxide, hydrogen and methane. Sulfur present in the coal is also in the gaseous coal gasification products primarily in the form of hydrogen sulfide and is removed prior to using the synthesis gas.

In coal gasification processes steam is often used to increase the efficiency and control the temperature of the process. The steam is also subjected to thermal decomposition for providing additional oxygen and hydrogen to the process to enhance the gasification of the coal and increase the hydrogen content of the gaseous gasification products. The thermal decomposition of steam in a coal gasifier is most efficient at temperatures above 2300° F., however, most gasifiers are normally operated at a temperatures below 2300° F. so that in such steam-aided gasification processes only about 35 to 40 percent of the steam is decomposed to hydrogen and oxygen. Decomposition of a greater percentage of the steam in the gasifier would significantly improve the efficiency and cost effectiveness of the coal gasification process especially in the reduction of external oxygen generation in oxygen-blown gasifiers.

SUMMARY OF THE INVENTION

Accordingly, it is the primary aim or objective of the present invention to provide for the decomposition of a significantly greater percentage of the steam injected into a coal gasifier than heretofore obtainable. In accordance with the present invention, the percentage of steam decomposition can be increased by a factor of at least two by injecting a thermochemical water-splitting agent into the gasification zone of the coal gasifier, preferably together with the combustion supporting medium (air, oxygen enriched air, or oxygen) and/or the steam. The gasification of coal in the presence of steam with enhanced decomposition of the steam to provide oxygen and hydrogen for use in the gasification of the coal and the enrichment of the product gases is achieved by the steps of heating coal in a combustion zone of a gasifier in the presence of a combustion supporting medium and steam. The reactants in the gasifier are heated to a temperature sufficient to effect gasification of the coal and the thermal decomposition of a portion of the steam to produce oxygen and hydrogen useful in the production of combustible gases during gasification. The water-splitting reaction is sensitive to temperature and can either increase the amount of steam decomposition if the temperature is held constant or produce the same amount of steam decomposition at lower temperatures. Water-splitting agents such as sulfuric acid, ferrous chloride, hydrogen chloride, and nitric acid are useable in practicing the present invention. Sulfuric acid is preferred since sulfur compounds produced during gasification can be converted to sulfuric acid and also since sulfuric acid can be easily recovered from the gasifier and recycled. The decomposition of the steam in accordance with the present invention is considerably enhanced by introducing a thermochemical water-splitting agent, such as sulfuric acid, into the gasification chamber to react with a further portion of the steam to produce additional oxygen and hydrogen. The sulfuric acid injected into the gasifier also reduces the steam decomposition temperature. The amount of additional oxygen and hydrogen produced with the similar quantities of steam and under similar gasification temperatures and pressures is a factor of at least two over that obtainable without the addition of the water-splitting agent.

With sulfuric acid as the water-splitting agent the sulfur component of the sulfuric acid water-splitting agent is discharged from the gasifier with the product gases and is separated there from for conversion to sulfuric acid. A portion of this sulfuri acid product may be readily recycled into the gasifier as the water-splitting agent in the process.

Other and further objects of the invention will be obvious upon an understanding of the illustrative embodiment and method about to be described or will be indicated in the appended claims. Also, various advantages not referred to herein will occur to one skilled in the art upon employment of the invention in practice.

BRIEF DESCRIPTION OF THE DRAWING

The FIGURE is a schematic view showing the flow diagram including a coal gasifier in which sulfuric acid is the water-splitting agent and is introduced into the gasifier with the steam and oxygen for enhancing the decomposition of the steam together with the flow steps utilized for the separation and conversion of sulfur in the gasification products to sulfuric acid for product and for recycle int the gasifier.

The embodiment of the invention shown was chosen for the purpose of illustration and description and is not intended to be exhaustive or to limit the invention to the precise form disclosed. The embodiment illustrated is chosen and described in order to best explain the principles of the invention and their application in practical use to thereby enable others skilled in the art to best utilize the invention in various embodiments and modifications as are best adapted to the particular use contemplated.

DETAILED DESCRIPTION OF THE INVENTION

With reference to the accompanying drawing, a coal gasification system as generally shown at 10 comprises a gasifier or reactor 12 having a combustion zone 14. Coal of a selected particle size is fed into the top of the gasifier or at any other suitable location through conduit 16 depending upon the type of gasifier which may be of a typical fixed bed, a moving bed, fluidized bed, entrained bed, or a slagging-or nonslagging-type combustor. The gasification of the coal introduced into the gasification zone 14 is achieved by introducing steam through conduit 18 coupled, as shown, to the lower portion of the gasifier 12 together with a combustion supporting medium, preferably oxygen as shown, being introduced through conduit 20. The steam and oxygen contact with the coal undergoing combustion is regulated to provide a gasification temperature in the range of about 1600° to 1900° F. for the production of gases formed primarily of carbon dioxide, carbon monoxide, hydrogen, and methane and which is discharged from the gasifier through conduit 22. Gaseous sulfur compounds, particularly hydrogen sulfide, are generated during the gasification of the coal and are discharged therefrom along with the product gases. Ash and other solid particulate material is discharged through the bottom of the gasifier 12 through conduit 24 in a typical manner. The gasifier 12 may operate at a pressure in the range of 0 to 1500 psig to provide for the gasification of the coal.

A portion of the steam introduced into the gasifier through conduit 18 is thermally decomposed in the gasifier to provide hydrogen and oxygen in accordance with the formula:

$$H_2O \xrightarrow{\Delta H} H_2 + .5O_2$$

The amount of the introduced steam decomposed to hydrogen and oxygen at temperatures in the range of about 1600° to 1900° F. is about 30 to 35 percent. As pointed out above, the decomposition of steam is more efficient at a temperature of about 2300° F. where about 35 to 40 percent of the steam is decomposed to hydrogen and oxygen.

In accordance with the present invention, the amount of steam decomposition is about doubled over that obtainable at 2300° F. and significantly greater than doubled at a temperature in the range of about 1600° to 1900° F. by injecting a thermochemical water-splitting agent into the combustion zone 14 of the gasifier 12. Preferably the water-splitting agent is sulfuric acid since it may be readily decomposed and recovered for recycling purposes without undergoing extensive process steps. Further, since the coal being gasified contains some sulfur this sulfur can be processed along with the sulfur from the water-splitting reaction for the production of sulfuric acid for recycling purposes and for use as an end-product. The sulfuric acid may be directly injected into the gasifier through a suitable conduit arrangement or combined with the oxygen and/or oxygen-steam stream prior to introduction into the combustion zone of the gasifier as shown where the sulfuric acid is directed into the steam conduit 18 through conduit 26. As the sulfuric acid is introduced into the gasifier 12, it becomes atomized and undergoes with the injected stea thermochemical decomposition and can be reformed in accordance with the equations (1) and (2) as follows:

$$H_2SO_4 \xrightarrow{\Delta H} SO_2 + H_2O + .5O_2 \quad (1)$$

$$2H_2O + SO_2 \longrightarrow H_2 + H_2SO_4 \quad (2)$$

The sulfuric acid completely decomposes in the combustion zone to produce water, sulfur dioxide and oxygen while utilizing a significant portion of the steam introduced into the gasifier for significantly increasing the efficiency of the gasification process as well as the enrichment the product gas in hydrogen. The introduction of the sulfuric acid reduces the steam decomposition temperature in the reactor to a temperature above the decomposition temperatures of the sulfuric acid which is about 1700° F. at ambient pressure.

With the sulfuric acid decomposed in the combustion zone of the gasifier, the resulting $SO_2$ is reduced to hydrogen sulfide in the reduction zone of the gasifier and discharged through line 22 together with the product gas. A considerable percent of this hydrogen sulfide may be attributed to the sulfur content of the coal which is also beneficially utilized within the sulfur recovery and sulfuric acid recycling steps.

As the product gases are discharged from the gasifier they are introduced into a chamber 28 where the sulfur compounds are extracted or absorbed from the gases in a conventional manner. For example, satisfactory sulfur removal may be achieved by passing the product through chamber 28 in which a suitable hydrogen sulfide adsorbent such as iron oxide or zinc ferrite is contained. The product gases are substantially stripped of the hydrogen sulfide and other sulfur compounds by the adsorbent and are then discharged through line 30 to a pipeline or other suitable point of use. The sulfur compound adsorbed on the sorbent may then be moved together with the adsorbent through conduit 31 to a suitable vessel 32, where the adsorbent is regenerated. Such regeneration may be achieved by adding oxygen to the vessel 32 through conduit 34 and then heating the vessel contents for producing sulfur dioxide and regenerating the adsorbent which may be recycled back to the chamber 28 in any suitable manner. The sulfur dioxide is conveyed through line 36 to a vessel 38 where water at near ambient temperatures is added through line 40 for the purpose of converting the sulfur dioxide to sulfuric acid in accordance with well known reactions. The sulfuric acid so produced is then conveyed from the chamber 38 through line 42 where a portion of this sulfuric acid in a concentration corresponding to about one molar percent of the steam addition to the gasifier is recycled through line 44 to conduit 26 for use as the water-splitting agent in the gasifier. The remaining sulfuric acid may be conveyed through line 46 as a product for use in any desired application. During the conversion of the sulfur dioxide to sulfuric acid in chamber 38, some hydrogen is generated. This hydrogen may be recycled back into the gasifier 12 or added to the product gas stream through conduit 48 as shown in the drawing.

As briefly mentioned above, the percentage of sulfuric acid recycled into the gasifier 12 is dependent on the needs of the gasifier 12. For example, with a steam rate of about 0.3 to 1.0 pound per pound of coal, a $H_2SO_4$ quantity of about 0.016 to 0.055 pound per pound of steam would be utilized together with the thermal decomposition to decompose about 70 to 98 percent of the steam present to hydrogen and oxygen. Also, the quantity of sulfuric acid produced by the present method is dependent upon the amount of sulfur contained in the coal so that with greater concentrations of sulfur naturally present, greater quantities of product acid can be produced.

It will be seen that the present invention provides a significant improvement in the operation of a gasifier in that the addition of relatively small quantities of sulfuric acid considerably increases the efficiency of the process due to the production of hydrogen and oxygen which is readily utilized in the process. The production of the oxygen in the gasifier effectively reduces the production requirements of an oxygen plant which is normally in place adjacent to the gasifier. Also, the use of the present invention reduces the overall cost of the product gases produced by the gasification process.

I claim:

1. A method for the gasification of coal in the presence of steam and a combustion supporting medium at a temperature less than about 2300° F., comprising the steps of heating coal in a gasifier in the presence of a combustion supporting medium and steam to a temperature less than about 2300° F. and sufficient to effect gasification of the coal and thermal decomposition of a first portion of the steam for producing oxygen and hydrogen, and introducing a sufficient amount of sulfuric acid as a water splitting agent into the gasifier for the thermochemical decomposition thereof while thermally decomposing said first portion of the steam for increasing by a factor of at least two the percent of steam thermally decomposable in the gasifier without the introduction of the sulfuric acid.

2. The method of coal gasification as claimed in claim 1, wherein oxygen-containing sulfur compounds produced by the thermochemical decomposition of the sulfuric acid are reduced therein by a second portion of said steam into gaseous sulfur compounds including hydrogen sulfide and are entrained in gaseous gasification products produced by the gasification of the coal and the thermal decomposition of said first portion of the steam, and including the additional steps of separating the gaseous sulfur compounds from the gaseous gasification products, converting the separated sulfur compounds to sulfuric acid, and recycling sulfuric acid resulting from the conversion to said gasifier.

3. The method of coal gasification as claimed in claim 2, wherein said temperature is in the range of about 1700° to about 2300° F., and wherein the gasifier is maintained at a pressure in the range of about 0 to 1500 psig during the gasification of the coal.

4. The method of coal gasification as claimed in claim 3, wherein said amount of sulfuric acid corresponds to about 0.016 to about 0.055 pounds per pound of steam added to the gasifier.

5. The method of coal gasification as claimed in claim 4, wherein the conversion of the separated hydrogen sulfide to sulfuric acid comprises the steps of heating the hydrogen sulfide in the presence of oxygen to produce sulfur dioxide and then reacting the resulting sulfur dioxide with water for producing hydrogen and sulfuric acid.

6. The method of coal gasification as claimed in claim 5, wherein the hydrogen produced during the reaction between sulfur dioxide and water is combined with the gaseous gasification products.

* * * * *